US005636557A

United States Patent [19]

Ma

[11] Patent Number: 5,636,557

[45] Date of Patent: Jun. 10, 1997

[54] RATCHET TYPE RING SPANNER

[76] Inventor: Nai-Lin Ma, No. 20, Ching Cheng Ten Street, West District, Taichung, Taiwan

[21] Appl. No.: 656,008

[22] Filed: May 24, 1996

[51] Int. Cl.[6] ..... B25B 13/46

[52] U.S. Cl. ..... 81/60

[58] Field of Search ..... 81/60, 61, 58, 81/62, 63, 63.1, 63.2

[56] References Cited

U.S. PATENT DOCUMENTS

| | | | |
|---|---|---|---|
| 1,459,291 | 6/1923 | Hall | 81/61 |
| 1,868,840 | 7/1932 | McNaught et al. | 81/61 |
| 2,957,377 | 10/1960 | Hare | 81/63 |
| 3,838,614 | 10/1974 | O'Donnell | 81/60 |

FOREIGN PATENT DOCUMENTS

| | | | |
|---|---|---|---|
| 3322967 | 1/1985 | Germany | 81/60 |

*Primary Examiner*—James G. Smith
*Assistant Examiner*—Joni B. Danganan
*Attorney, Agent, or Firm*—Charles E. Baxley, Esq.

[57] ABSTRACT

A ratchet-type ring spanner includes a handle and a head portion which, in turn, includes a circular peripheral wall defining a receiving compartment therein and including a web area which connects with the handle, a cavity being defined in the web area. A ratchet wheel is received in the compartment and includes a plurality of teeth in an outer periphery thereof and a polygonal inner periphery. An arcuate toothed member is mounted in the cavity and includes a plurality of teeth defined on a first side thereof for engaging with the teeth of the ratchet wheel and a second side bearing against a wall defining the cavity. A stop member is mounted in the cavity and includes a first end thereof bearing against the wall defining the cavity. A spring is mounted between the stop member and the toothed member to bias the toothed member away from the stop member.

3 Claims, 7 Drawing Sheets

RATCHET TYPE RING SPANNER

BACKGROUND OF THE INVENTION

1. Field of the Invention

The present invention relates to a ratchet-type ring spanner and, more particularly, to an improved ring spanner which is particularly useful for repairmen.

2. Description of the Related Art

Hand tools play a role in a civilized society, and spanners are the most important one in the field of hand tools since the invention of the bolts and nuts. A wide variety of spanners have been available heretofore, such as combination wrenches, open wrenches, ring spanners, socket ratchet wrenches, etc. FIG. 6 of the drawings illustrates a socket ratchet wrench which includes a handle 40 and a switch button 41 mounted in a head portion 42 thereof to change a reversible direction of a ratchet mounted in the head portion 42 during operation. A drawback of the socket ratchet wrench is that a user has to hold the socket ratchet wrench with one hand and switch the switch button 41 when changing the reversible direction. A further drawback of the socket ratchet wrench is that it has a relatively large end in order to accommodate complex elements therein, and thus cannot be used in a limited space as additional sockets have to be used.

A professional repairman would use a combination wrench (see FIG. 7 of the drawing), open wrenches or ring spanners in a limited space for tightening or loosening of nuts. Yet a common drawback of these spanners/wrenches is that, after being rotated through a small angle, the spanner/wrench has to be removed from the nut and re-engaged with the nut for being rotated through another small angle. This process continues until tightening or loosening of the nut is accomplished, which is very inconvenient, especially in a limited space.

A reversible ring spanner has been proposed to solve the above-mentioned drawbacks, such spanner includes a ratchet wheel mounted in an inner periphery of a head portion thereof and a cavity defined in a web area thereof for receiving a spring and a pawl therein. The pawl is biased by the spring to engage with and disengage from the ratchet wheel to provide the required reversible function. It is, however, found that, as the pawl merely engages with one tooth of the ratchet wheel, the obtained torque is relatively small, and the pawl may be damaged if a relatively large force is applied. In addition, it is very difficult to provide a cavity in the web area of the spanner with a thickness of one (1) centimeter. Furthermore, the cavity must extend in an oblique manner in order to assure proper engagement between the ratchet wheel and the pawl, which further increases the difficulty of provision of the cavity as the tolerable error is extremely small. Although the problem can be solved by increasing the thickness of the head of the spanner, yet the enlarged head, like those of socket ratchet wrenches, would not allow the spanner to be operated in a limited space.

Therefore, there has been a long and unfulfilled need for an improved ratchet-type ring spanner to mitigate and/or obviate the above problems.

SUMMARY OF THE INVENTION

It is an object of the present invention to provide a ratchet-type ring spanner for professional repairmen which can be operated easily and assembled conveniently.

It is another object of the present invention to provide a ratchet-type ring spanner which still functions reliably even if alien objects enter therein.

A ratchet-type ring spanner in accordance with the present invention comprises a handle and a head portion which includes a circular peripheral wall defining a receiving compartment therein and including a web area which connects with the handle, a cavity being defined in the web area. A ratchet wheel is received in the compartment and includes a plurality of teeth in an outer periphery thereof and a polygonal inner periphery for engaging sides of a nut to be tightened or loosened.

An arcuate toothed member is mounted in the cavity and includes a plurality of teeth defined on a first side thereof for engaging with the teeth of the ratchet wheel and a second side bearing against a wall defining the cavity. A stop member is mounted in the cavity and including a first end thereof bearing against the wall defining the cavity. A spring is mounted between the stop member and the toothed member to bias the toothed member away from the stop member. In one embodiment of the invention, the first end of the stop member includes two protrusions for bearing against the wall defining the cavity.

In accordance with one aspect of the invention, the toothed member includes a stub formed thereon and the stop member includes a post extending therefrom, while the spring has a first end attached to the stub of the toothed member and a second end attached to the post of the stop member.

In accordance with a further aspect of the invention, the stop member further includes a pair of wings respectively extending outwardly from mediate portions of two longitudinal edges thereof in a plane substantially perpendicular to a longitudinal direction thereof. The wings function as a guiding rail for the toothed member for disengagement of the toothed member from the ratchet wheel in the case that an alien object enters the cavity, thereby allowing the toothed member to return to its initial position for subsequent operation without being disturbed by the alien objects.

In accordance with another aspect of the invention, the wall defining the cavity includes a depression defined in a mediate portion thereof, while the stop member further includes an anchor formed thereon and received in the depression.

Other objects, advantages, and novel features of the invention will become more apparent from the following detailed description when taken in conjunction with the accompanying drawings.

DESCRIPTION OF THE PREFERRED EMBODIMENT

Figure 1:
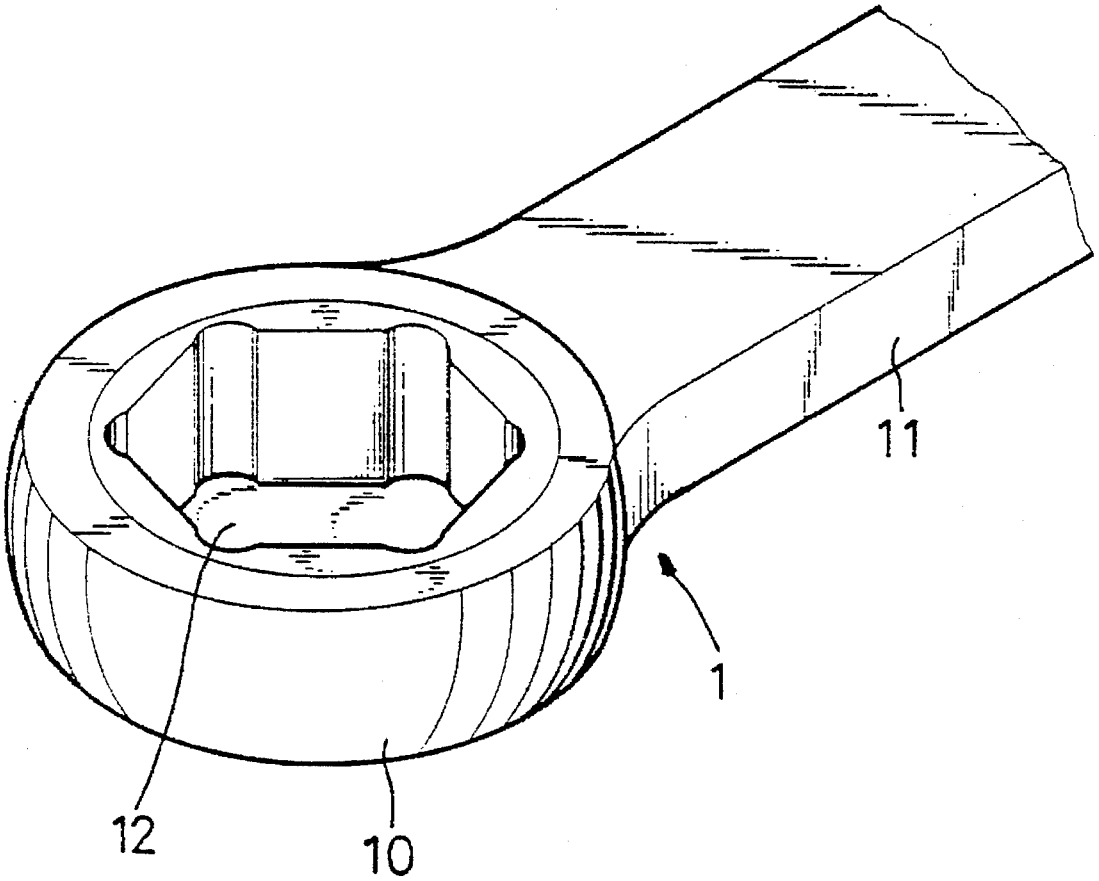
FIG. 1 is a perspective view of a part of a ratchet-type ring spanner in accordance with the present invention.
Figure 2:
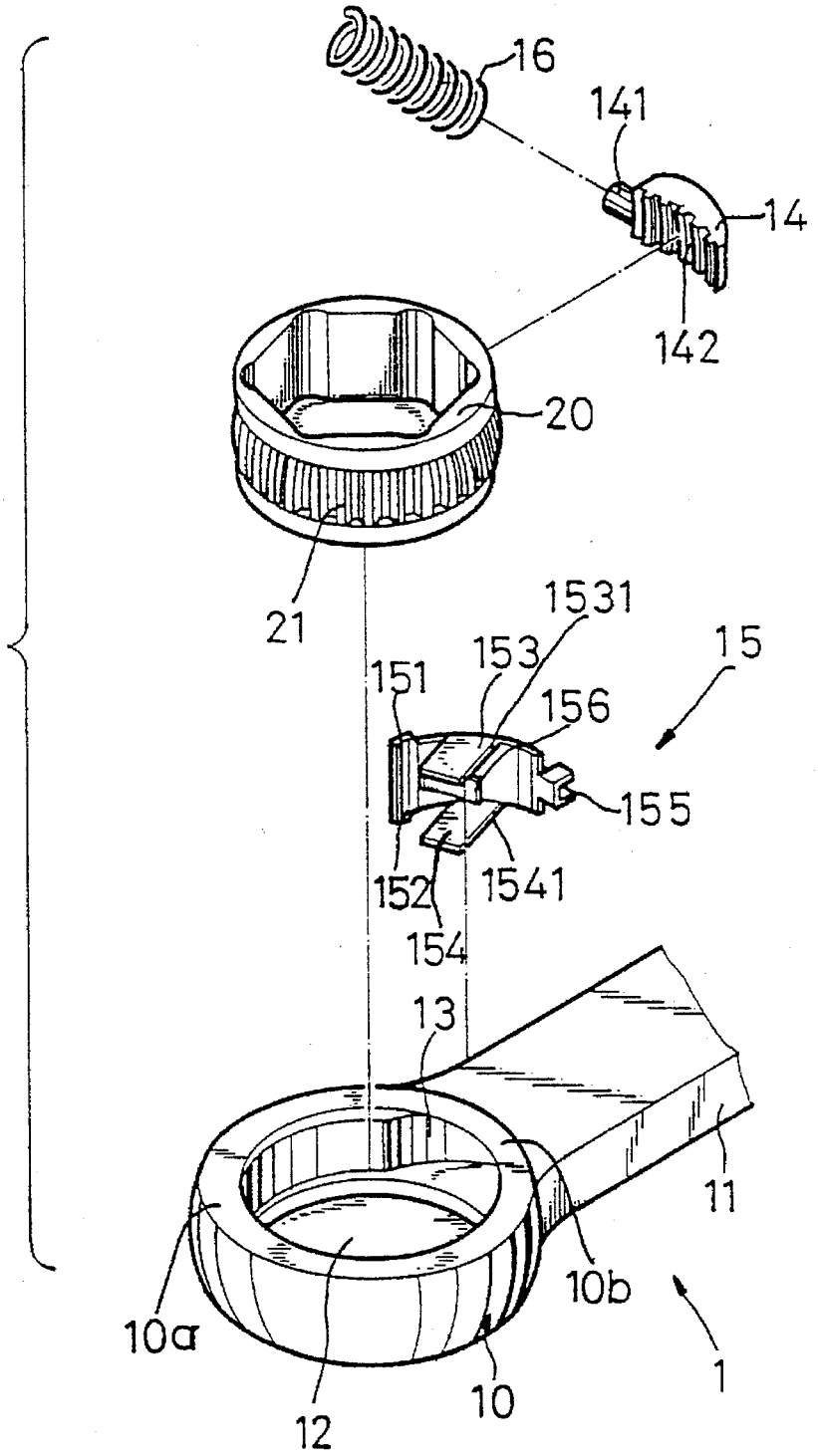
FIG. 2 is an exploded view of the ratchet-type ring spanner in FIG. 1.
Figure 3:
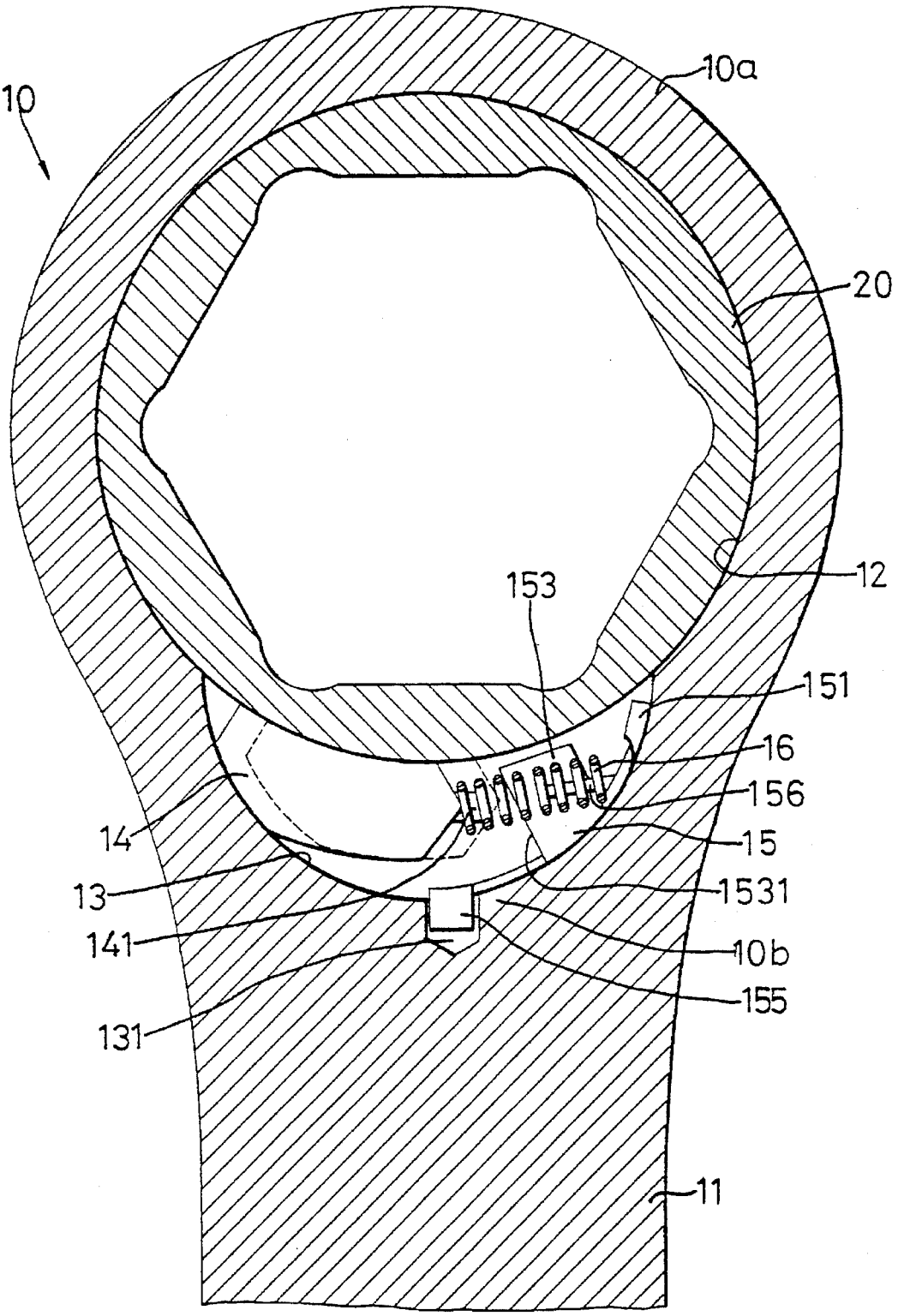
FIG. 3 is a cross-sectional view of the ratchet-type ring spanner in accordance with the present invention.

Referring now to FIGS. 1 to 5 and initially to FIGS. 1 to 3, a ratchet-type ring spanner in accordance with the present invention is designated by reference numeral "1" and generally includes a handle 11 and a head portion 10. The head portion 10 includes a circular peripheral wall 10*a* defining a receiving compartment 12 therein for receiving a ratchet wheel 20 therein. The peripheral wall 10*a* includes a web area 10*b* which connects with the handle 11. A cavity 13 is defined in the web area 10*b* and a depression 131 is defined in a mediate portion of a wall defining the cavity 13 (see FIG. 3).

Referring to FIGS. 2 and 3, the ratchet wheel 20 includes a plurality of teeth 21 in an outer periphery thereof and a polygonal inner periphery for engaging with sides of a nut or the like. An arcuate toothed member 14 is mounted in the cavity 13 and includes a stub 141 formed on one end thereof and a plurality of teeth 142 defined on a first side thereof for engaging with the teeth 21 of the ratchet wheel 20. Also mounted in the cavity 13 is a stop member which is a resilient plate 15 including two protrusions 151 and 152 formed on a first end thereof and a substantially U-shaped anchor 155 formed on a second end thereof and received in the depression 131. The resilient plate 15 further includes a post 156 extending outwardly from a mediate portion of a side thereof and a pair of wings 153 and 154 respectively extending outwardly from mediate portions of two longitudinal edges thereof in a plane substantially perpendicular to a longitudinal direction thereof.

In assembly, the stop member 15 is inserted into a side of the cavity 13 in which the protrusions 151 and 152 of the first end of the stop member 15 firmly bears against the wall defining the cavity 13, and the anchor 155 is received in the depression 131. The arcuate toothed member 14 is then inserted into the other side of the cavity 13 with a second side thereof bearing against the wall defining the cavity 13 and with the stub 141 thereof facing the post 156 of the stop member 15. A spring 16 is mounted between the stop member 15 and the arcuate toothed member 14 in which a first end thereof is attached to the stub 141 and a second end thereof is attached to the post 156, as shown in FIG. 3. The ratchet wheel 20 is then inserted into the receiving compartment 12 of the head portion 10 in which the teeth 21 thereof engages with the teeth 142 on the first side of the toothed member 14.

Figure 4:
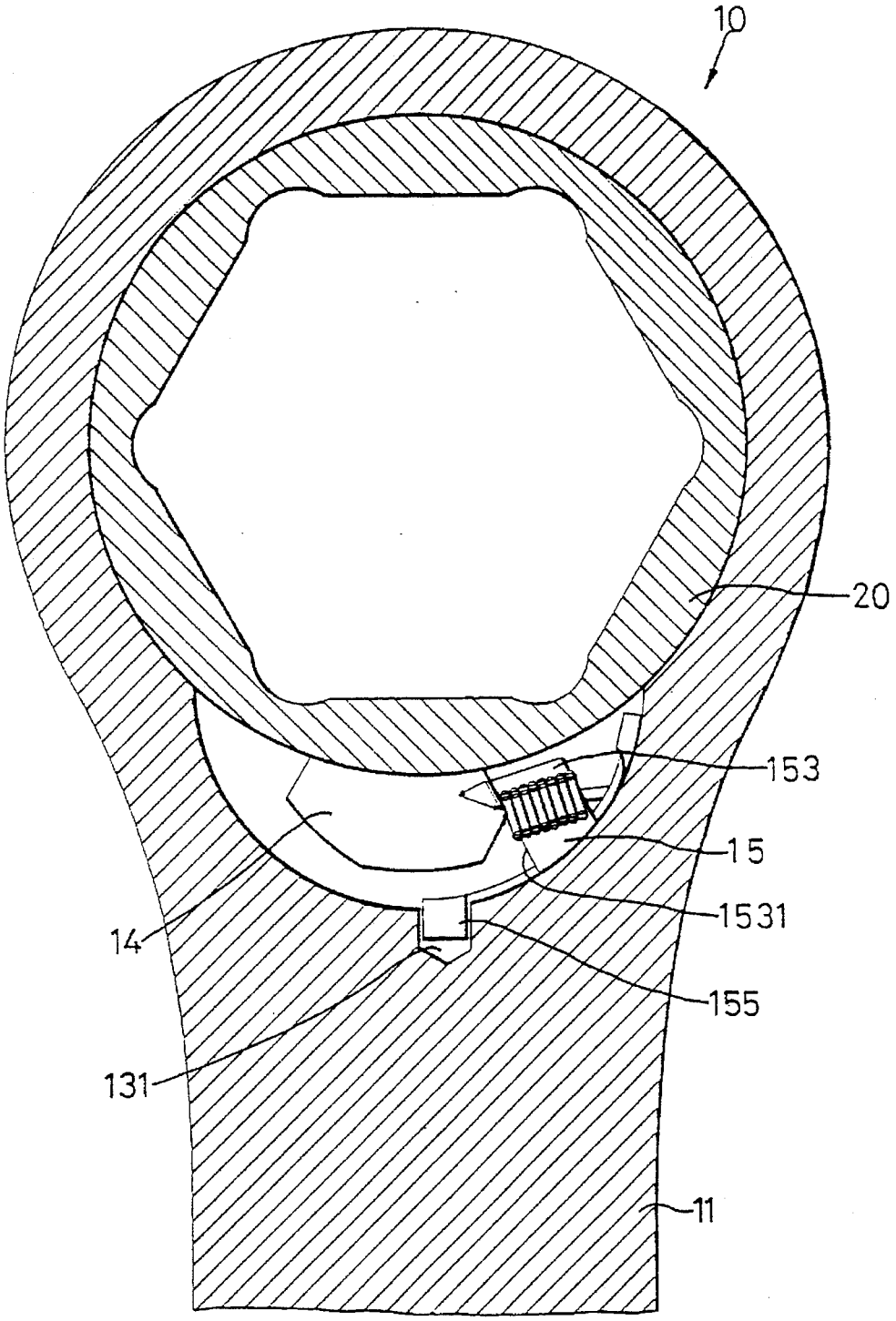
FIG. 4 is a cross-sectional views similar to FIG. 3, illustrating operation of the ratchet-type ring spanner under a normal condition.

In operation, a nut (not shown) to be loosened or tightened engages with the ratchet wheel 20 in a conventional manner and the user may operate the ring spanner at the handle 11 to urge the head portion 10 as well as the nut to rotate in a first direction, e.g., clockwise, If the head portion 10 travels through a certain angle, the toothed member 14 is moved to a position shown in FIG. 4 (as the ratchet wheel 20 engages with the toothed member 14) and the spring 16 is thus compressed. When it is necessary to move the ring spanner back to its initial position, the user needs not to lift the ring spanner upwardly to disengage from the nut and then lower the ring spanner for reengaging with the nut. Instead, the user may directly move the ring spanner in an opposite direction, e.g., counterclockwise, as it provides a reversible function. This is because the spring force provided by the spring 16 pushes the toothed member 14 back to its initial position shown in FIG. 3, while the structures of the teeth 142 of the toothed member and the teeth 21 of the ratchet wheel 20 allow such rotation in the opposite direction.

Figure 5:
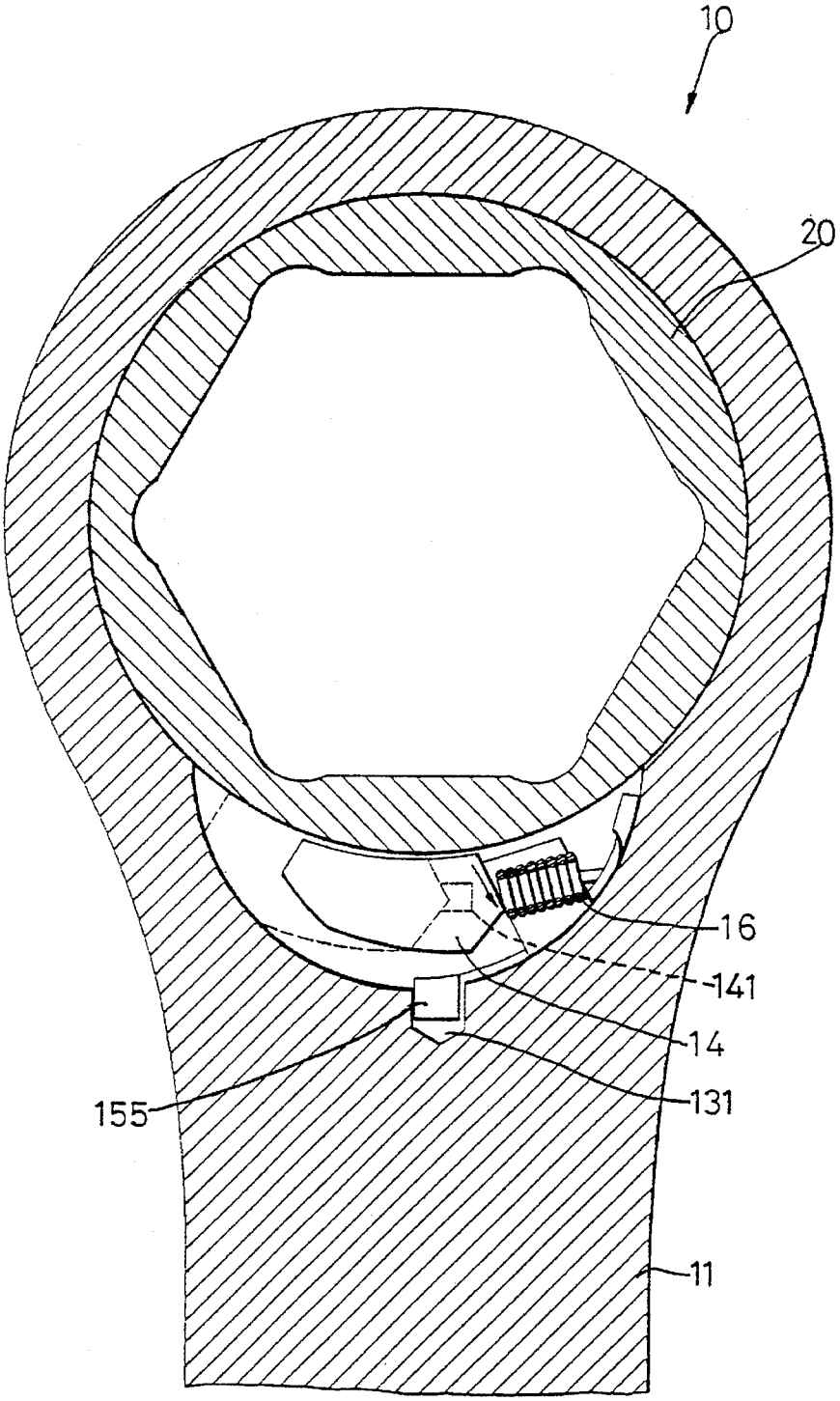
FIG. 5 is a cross-sectional views similar to FIG. 3, illustrating operation of the ratchet-type ring spanner under the condition of intrusion of alien objects.
Figure 6:
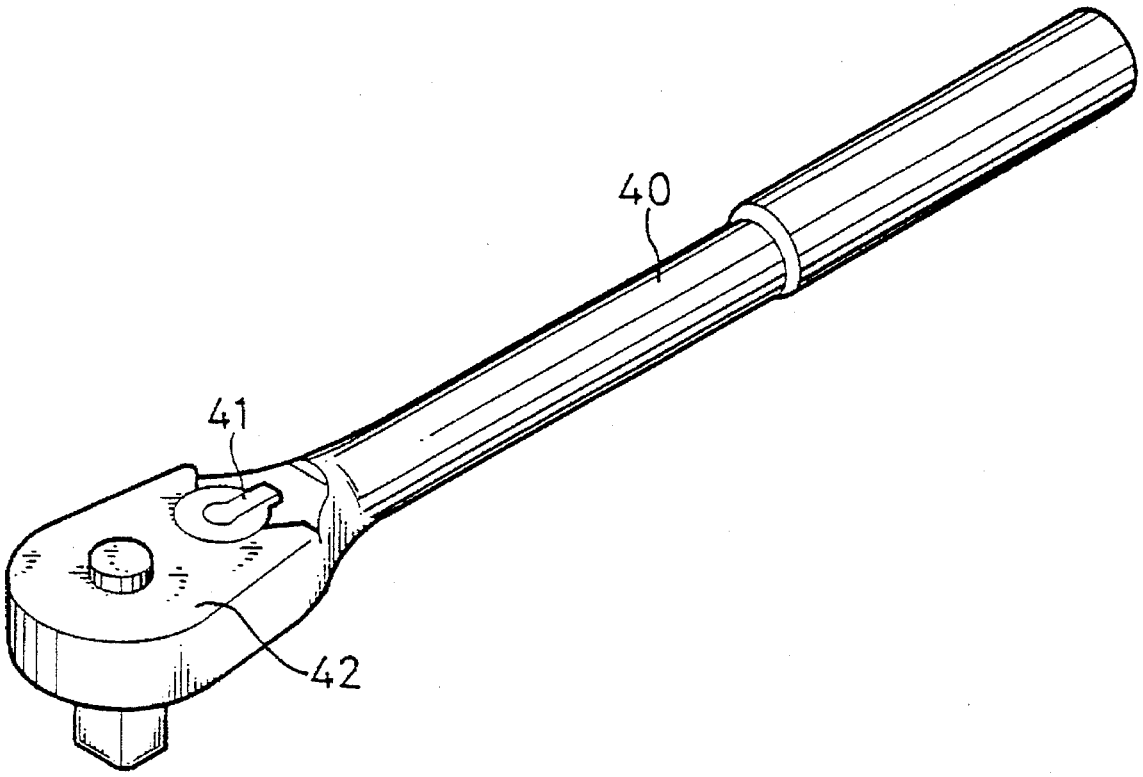
PRIOR ART Fig 6
FIG. 6 is a perspective view of a conventional socket ratchet wrench.
Figure 7:
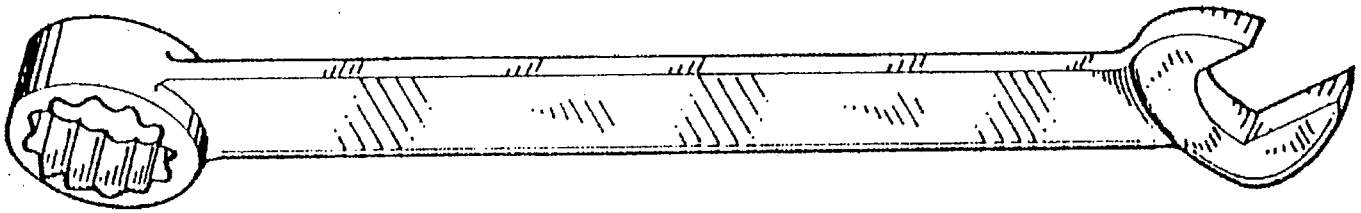
PRIOR ART Fig 7
FIG. 7 is a perspective view of a conventional combination wrench.

If an alien object intrudes the cavity 13 of the head portion, which tends to occur frequently during repair, the toothed member 14, as being impeded by the alien object, may not immediately move back to its initial position when the above-mentioned reverse travel is required. This is because the toothed member 14 is not allowed to disengage with the ratchet wheel 20. Under this condition, the toothed member 14 is carried by ratchet wheel 20 to move further rightwardly (as seen from the direction of FIG. 4) and thus impinges the wings 153 and 154 of the stop member 15 which accordingly gives a force to the stop member 15. The force results in a normal force and a longitudinal force which cause the toothed member 14 to slide along lateral edges 1531 and 1541 of the wings 153 and 154 for a certain distance (see the arrow in FIG. 5) and thus disengages from the ratchet wheel 20, as shown in FIG. 5. In other words, the wings 153 and 154 serve as a guiding rail to guide downward movements of the toothed member 14, thereby disengaging the toothed member 14 from the ratchet wheel 20. The spring force provided by the spring 16 is now able to push the toothed member 14 back to its initial position shown in FIG. 3. Thus, the ratchet-type ring spanner may function as usual even if alien objects enter. The alien objects may be removed periodically or immediately after finish of repair.

Although the invention has been explained in relation to its preferred embodiment, it is to be understood that many other possible modifications and variations can be made without departing from the spirit and scope of the invention as hereinafter claimed.

What is claimed is:

1. A ratchet-type ring spanner comprising a handle and a head portion, the head portion comprising:

a circular peripheral wall defining a receiving compartment therein and including a web area which connects with the handle, a cavity being defined in the web area, a ratchet wheel received in the compartment and including a plurality of teeth in an outer periphery thereof and a polygonal inner periphery, an arcuate toothed member mounted in the cavity and including a plurality of teeth defined on a first side thereof for engaging with the teeth of the ratchet wheel and a second side bearing against a wall defining the cavity, a stop member mounted in the cavity and including a first end thereof bearing against the wall defining the cavity, a spring mounted between the stop member and the toothed member to bias the toothed member away from the stop member, the stop member further including a pair of wings respectively extending outwardly from mediate portions of two longitudinal edges thereof in a plane substantially perpendicular to a longitudinal direction thereof.

2. The ratchet-type ring spanner as claimed in claim 1, wherein the wall defining the cavity includes a depression defined in a mediate portion thereof, while the stop member further includes an anchor formed thereon and received in the depression.

3. The ratchet-type ring spanner as claimed in claim 1, wherein the first end of the stop member includes two protrusions for bearing against the wall defining the cavity.

* * * * *